US012358680B2

(12) United States Patent
Mertzel

(10) Patent No.: US 12,358,680 B2
(45) Date of Patent: Jul. 15, 2025

(54) SIMPLIFIED CAP FOR SQUEEZE BOTTLE

(71) Applicant: Kitchen Concepts Unlimited, Northridge, CA (US)

(72) Inventor: Joelle Mertzel, Porter Ranch, CA (US)

(73) Assignee: Kitchen Concepts Unlimited LLC, Northridge (CA)

( * ) Notice: Subject to any disclaimer, the term of this patent is extended or adjusted under 35 U.S.C. 154(b) by 233 days.

(21) Appl. No.: 18/219,690

(22) Filed: Jul. 9, 2023

(65) Prior Publication Data

US 2025/0011032 A1 Jan. 9, 2025

(51) Int. Cl.

| | |
|---|---|
| ***B65D 47/04*** | (2006.01) |
| ***B65D 1/32*** | (2006.01) |
| ***B65D 41/04*** | (2006.01) |

(52) U.S. Cl.

CPC ..... *B65D 1/326* (2013.01); *B65D 41/0428* (2013.01); *B65D 2547/06* (2013.01)

(58) Field of Classification Search

CPC .. B65D 47/305; B65D 47/061; B65D 47/065; B65D 41/0457; B65D 2251/205

See application file for complete search history.

(56) References Cited

U.S. PATENT DOCUMENTS

| | | | | | |
|---|---|---|---|---|---|
| 1,051,688 | A * | 1/1913 | Cole | B65D 47/305 | 222/536 |
| 1,250,081 | A * | 12/1917 | Bennis | B65D 47/061 | 251/91 |
| 2,701,668 | A * | 2/1955 | Zayan | B65D 47/305 | 222/536 |
| 2,727,658 | A * | 12/1955 | Mart | B65D 47/305 | 222/536 |
| 3,163,337 | A * | 12/1964 | Woodrow | B65D 47/305 | 222/536 |
| RE26,318 | E * | 12/1967 | Wilson | B65D 47/305 | 222/536 |
| 3,568,895 | A * | 3/1971 | Porter | B65D 47/305 | 222/536 |
| 3,751,787 | A * | 8/1973 | Porter | B65D 47/305 | 222/536 |
| 4,674,661 | A * | 6/1987 | Herold | B05C 17/00593 | 222/533 |

* cited by examiner

*Primary Examiner* — Paul R Durand
*Assistant Examiner* — Randall A Gruby
(74) *Attorney, Agent, or Firm* — Andrus Intellectual Property Law, LLP

(57) ABSTRACT

A cap for a squeeze bottle that is simply constructed, easily manufactured, simple to assemble and easily reassembled. The cap includes three components, a rounded lid with a slot, a nozzle with a near spherical base and an extended cone portion, and a gasket with a platform, a nozzle seat and a skirt wall.

20 Claims, 15 Drawing Sheets

SIMPLIFIED CAP FOR SQUEEZE BOTTLE

FIELD OF THE INVENTION

The present invention relates generally to caps for squeeze bottles and more particularly to a simple three-part cap that is robust and simply constructed.

BACKGROUND OF THE INVENTION

Various squeeze bottle apparatus are known in the prior art. Generally, squeeze bottles are defined in Wikipedia as "a type of container such as a plastic bottle for dispensing a fluid, that is powered by squeezing the container with the user's hand. Its fundamental characteristic is that manual pressure applied to a resilient hollow body is harnessed to compress fluid within it and thereby expel the fluid through some form of nozzle." Examples include common plastic condiment bottles for ketchup and mustard. These typically are formed with a cylindrical squeeze bottle and a threaded cap with a fixed tapered nozzle. Some caps have open nozzles while others have small covers. Other examples are found in beauty shops and pet grooming establishments and are used for soaps and dyes.

All of the examples tend to be messy and somewhat difficult to use. For better control, some squeeze bottles have rotating nozzles that close the bottle when the nozzle stem is perpendicular to the longitudinal axis of the bottle and open the bottle when the nozzle stem is pointed upward or generally parallel to the longitudinal axis of the bottle. However, these caps are structurally complicated, as shown here in FIGS. 22-25, of the accompanying drawings, they are difficult to make and assemble by the manufacturer, they are difficult to reassemble by the consumer when disassembled for washing, and they tend to leak.

The inventive apparatus disclosed and claimed here should alleviate these problems.

SUMMARY OF THE INVENTION

The inventive cap apparatus is simply constructed and includes a lid component having a rounded shape, an open bottom, a threaded inner portion for engaging a threaded outer portion of a bottle, the threaded inner portion of the lid having a first diameter, the lid component also having an integral lower flange located above the threaded inner portion, an integral sidewall having multiple grooves extending away from the lower flange above the threaded inner portion, an integral beveled surface above the sidewall, an integral upper flange, an integral curved nozzle seat located above the grooves and the upper flange, and a curved nozzle slot; a nozzle component having a generally spherical base with a central opening and an extended conical stem with a central opening, a centerline of the central openings of the base and the conical stem defining a longitudinal axis of the nozzle component, the spherical base for being received by the nozzle seat of the lid component, and the conical stem for rotating within the curved nozzle slot; and a gasket component having a lower circular flange, a circular platform integral with the lower flange, the platform having a sidewall with multiple ribs, each rib for being received by a corresponding groove in the lid component, the circular platform including a top wall surrounding a partial spherically shape seat for the base of the nozzle component, and the top wall extending around to a recess for seating the conical stem of the nozzle, the nozzle seat having a central opening, the central opening in the nozzle seat for selectively aligning with the central openings of the nozzle base and the conical stem of the nozzle component to enable the flowable content of the bottle to exit the bottle wherein the conical stem of the nozzle component is able to rotate about ninety degrees between a closed position where the bottle is closed and the conical stem of the nozzle component is generally perpendicular to a longitudinal axis of the bottle and an open position where the bottle is open and the conical stem of the nozzle component is generally parallel to the longitudinal axis of the bottle.

The invention also relates to a method for assembling a cap apparatus for a squeeze bottle including the steps of providing a rounded lid component having an open bottom, a threaded inner portion for engaging a threaded outer portion of a squeeze bottle, the threaded inner portion of the lid having a first diameter, an integral lower flange located above the threaded inner portion, an integral a sidewall having multiple grooves extending away from the lower flange above the threaded inner portion, an integral beveled surface located above the sidewall, an integral upper flange, an integral curved nozzle seat located above the grooves and the upper flange, and a curved nozzle slot; providing a nozzle component having a generally spherical base with a central opening and an extended conical stem with a central opening, a centerline of the central openings of the spherical base and the conical stem defining a longitudinal axis of the nozzle component; providing a gasket component having a lower circular flange, a circular platform integral with the lower flange, the platform having a sidewall with multiple ribs, each rib for being received by a corresponding groove in the lid, the circular platform including a top wall surrounding a partial spherical-shaped seat for the spherical base of the nozzle component and extending around the platform to a recess, the recess for seating the conical stem of the nozzle component, the nozzle seat having an opening for selectively aligning with the central openings of the spherical base and the conical stem; locating the spherical base of the nozzle component in the nozzle seat of the lid component and the partial spherical seat of the gasket component; locating the conical stem within the curved nozzle slot of the lid component and selectively in the recess of the gasket component; locating the opening in the nozzle seat of the gasket component for selectively aligning with the central openings of the spherical base and the conical stem of the nozzle component to enable flowable content in the bottle to exit the bottle when the longitudinal axis of the nozzle component is generally parallel with a longitudinal axis of the bottle wherein the conical stem of the nozzle component is able to rotate about ninety degrees between an open position where the longitudinal axes of the nozzle component and of the bottle are generally parallel and a closed position where the central opening of the nozzle conical stem is generally perpendicular to the longitudinal axis of the bottle.

BRIEF DESCRIPTION OF THE DRAWINGS

For the purpose of facilitating an understanding of the invention, the accompanying drawings and detailed description illustrate a preferred embodiment thereof, from which the invention, its structures, its constructions and operations, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
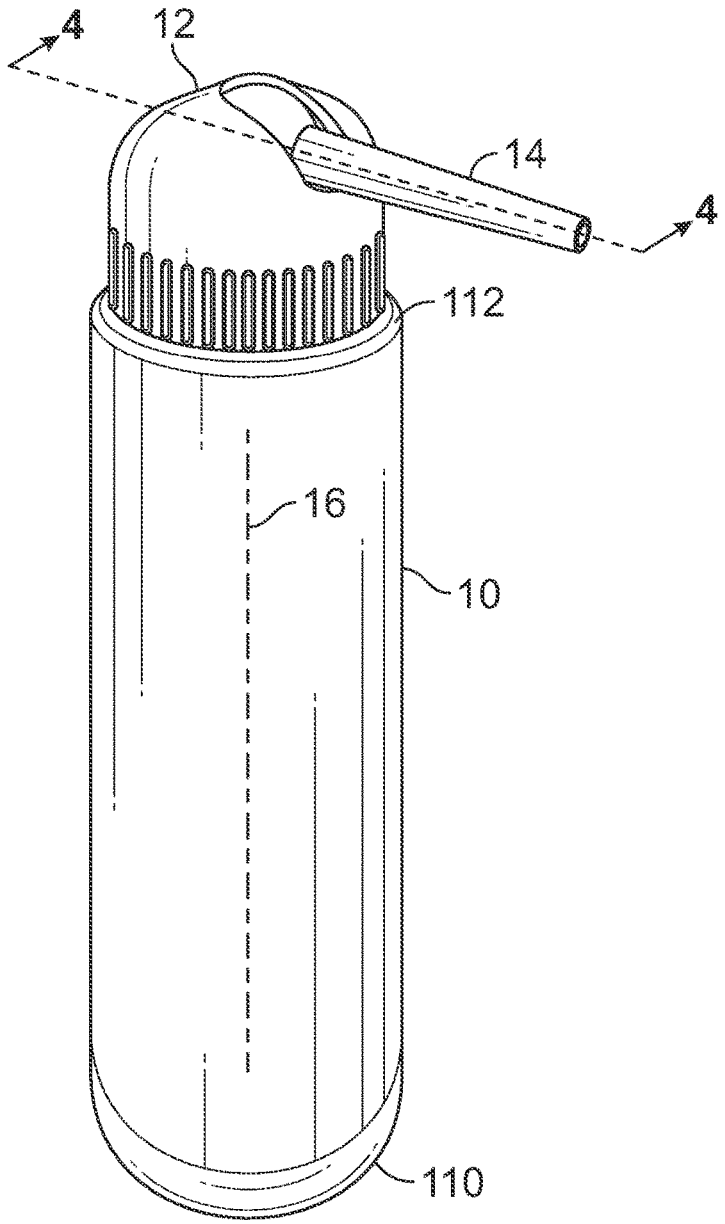
FIG. 1 is an isometric view of the inventive cap apparatus attached to a squeeze bottle where the cap is in a closed position.
Figure 2:
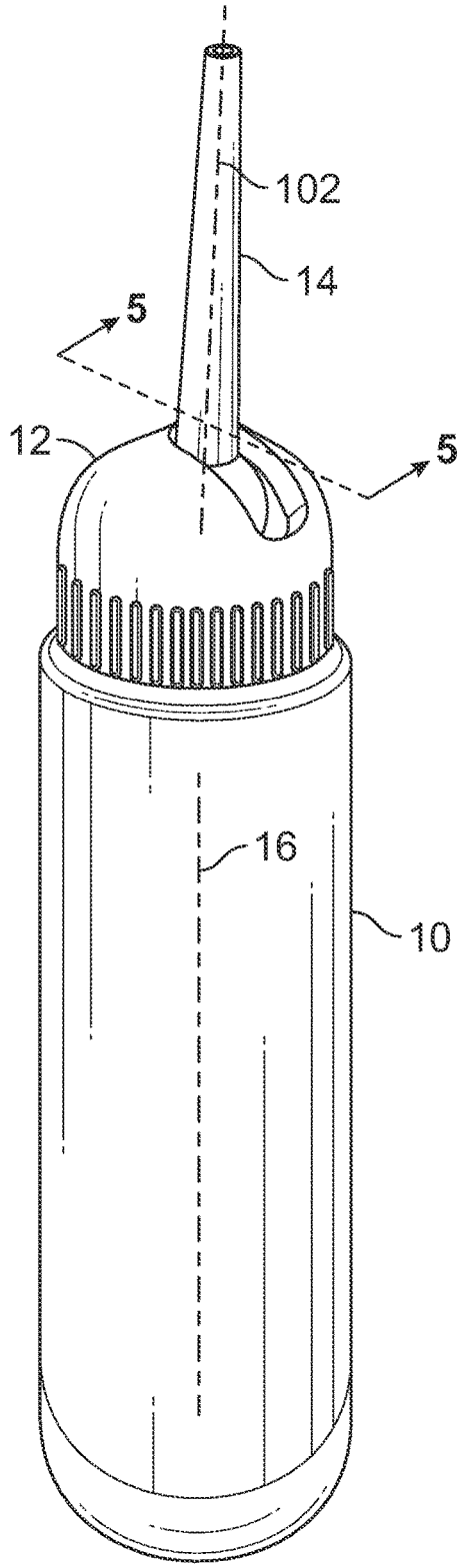
FIG. 2 is an isometric view of cap and squeeze bottle shown in FIG. 1, where the cap is in an open position.

Referring to FIGS. 1 and 2, there is shown a squeeze bottle 10 with the inventive cap 12, the cap having a rotatable nozzle component 14, that closes the bottle 10 when the nozzle component extends generally perpendicular to a longitudinal axis 16 of the bottle 10 (see FIG. 1), and when the nozzle component 14 extends generally parallel to the longitudinal axis 16 (see FIG. 2), the bottle opens.

Figure 3:
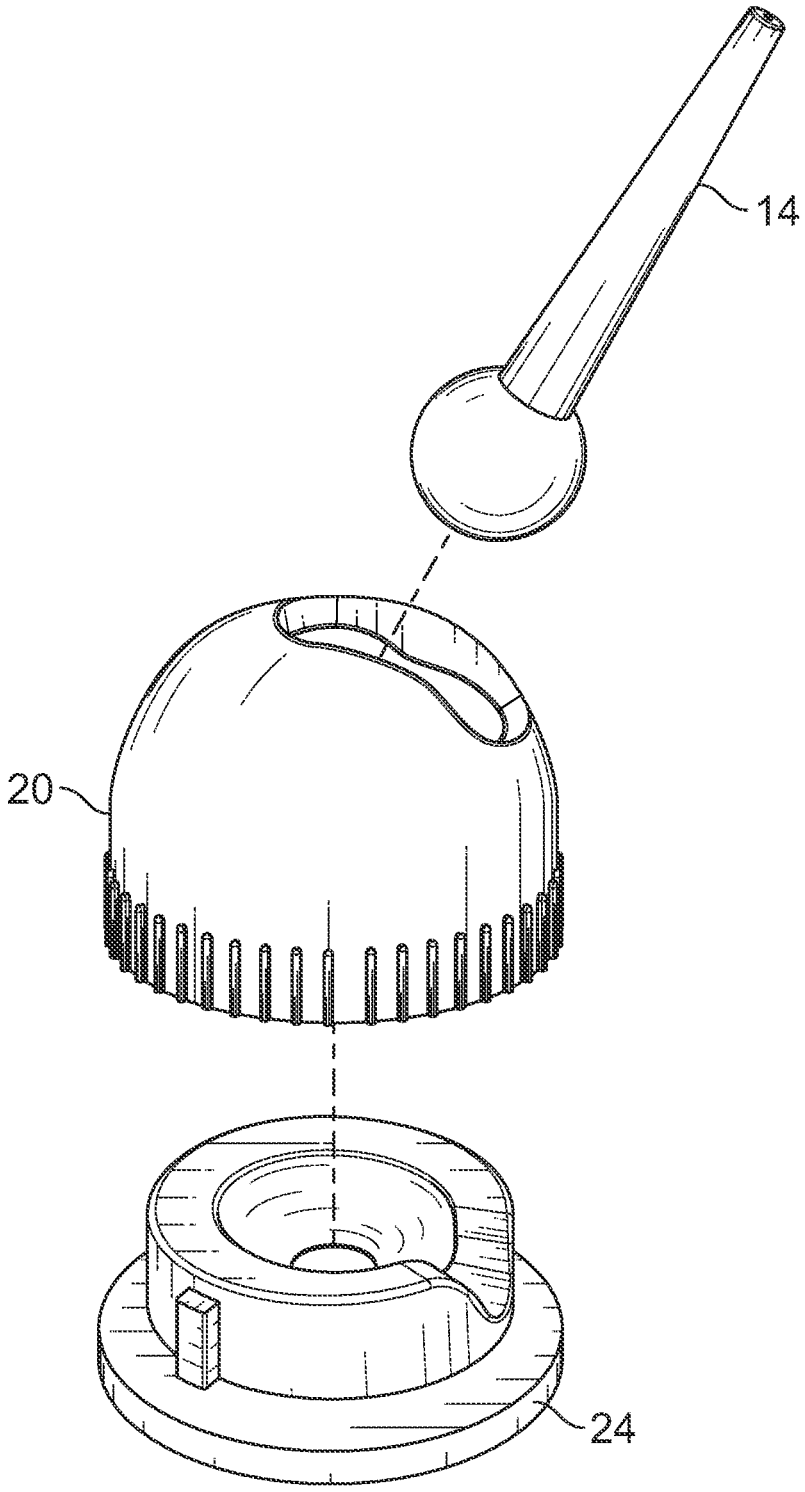
FIG. 3 is an enlarged exploded isometric view of the cap shown in FIGS. 1 and 2.
Figure 4:
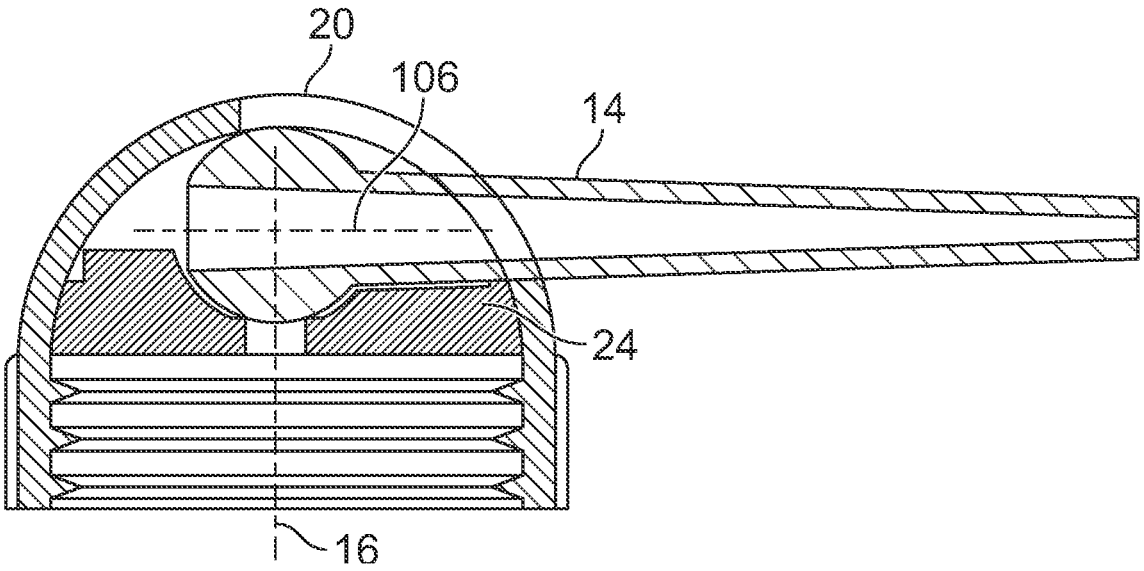
FIG. 4 is an enlarged cross-sectional view of the cap taken along line 4-4 in FIG. 1.

The inventive cap 12 includes three simply constructed components shown in exploded view in FIG. 3, a lid component 20 (also shown in FIGS. 6-11), the nozzle component 14 (also shown in FIGS. 13-16, and a gasket component 24 (also shown in FIGS. 17-21). In FIG. 4, the cap 12 is shown in a closed position in a cross-sectional view, and in FIG. 5, the cap 12 is shown in an open position in a similar cross-sectional view.

Figure 5:
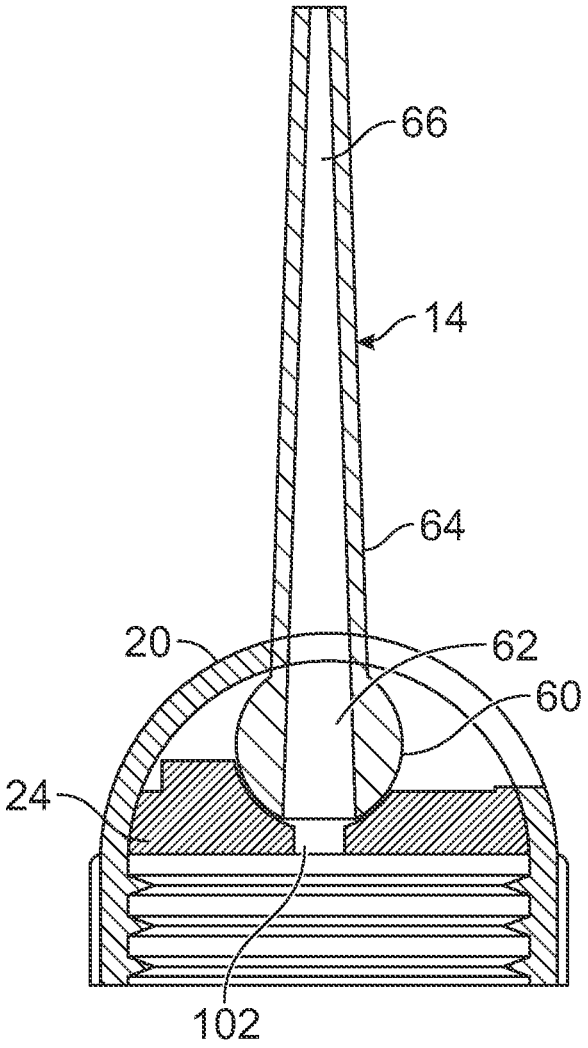
FIG. 5 is an enlarged cross-sectional view of the cap taken along line 5-5 of FIG. 2.
Figure 6:
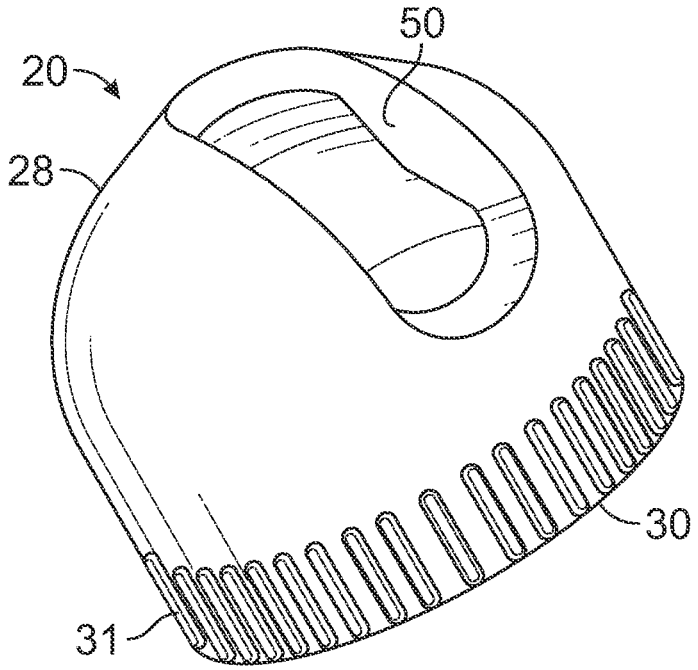
FIG. 6 is an enlarged isometric view of a lid component of the cap shown in FIGS. 1-3.
Figure 7:
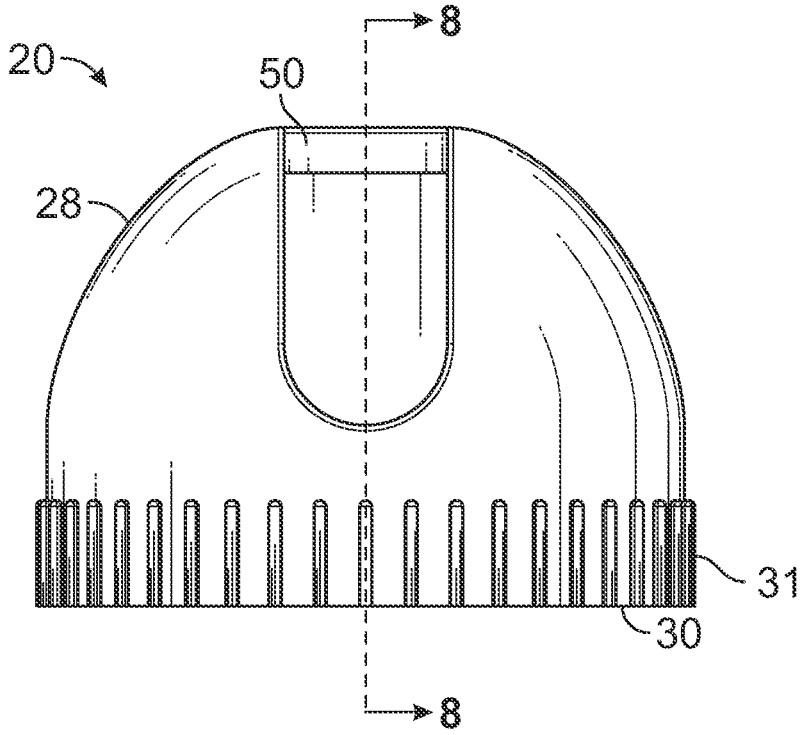
FIG. 7 is a front elevation view of the lid component shown in FIG. 6.
Figure 8:
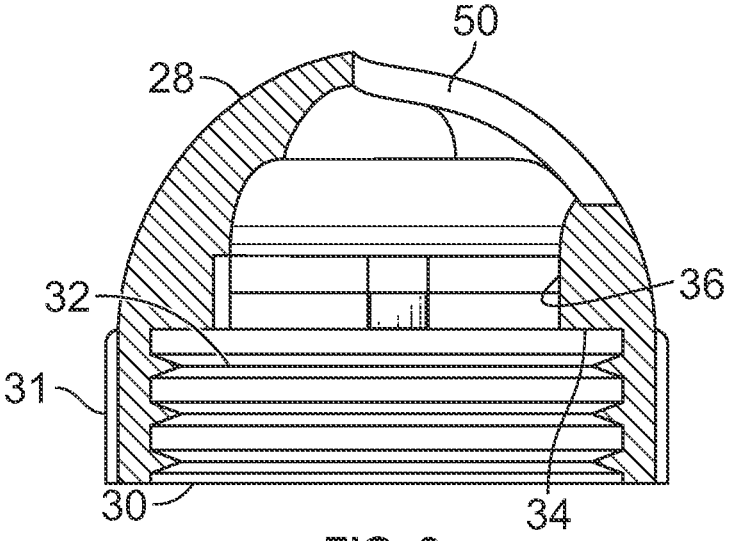
FIG. 8 is a cross-sectional view along line 8-8 in FIG. 7.
Figure 9:
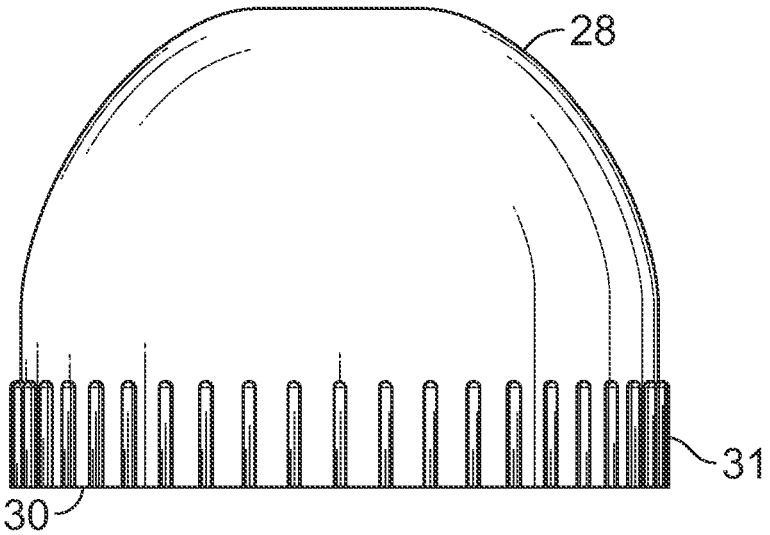
FIG. 9 is a rear elevation view of the lid component shown in FIGS. 6-8.
Figure 10:
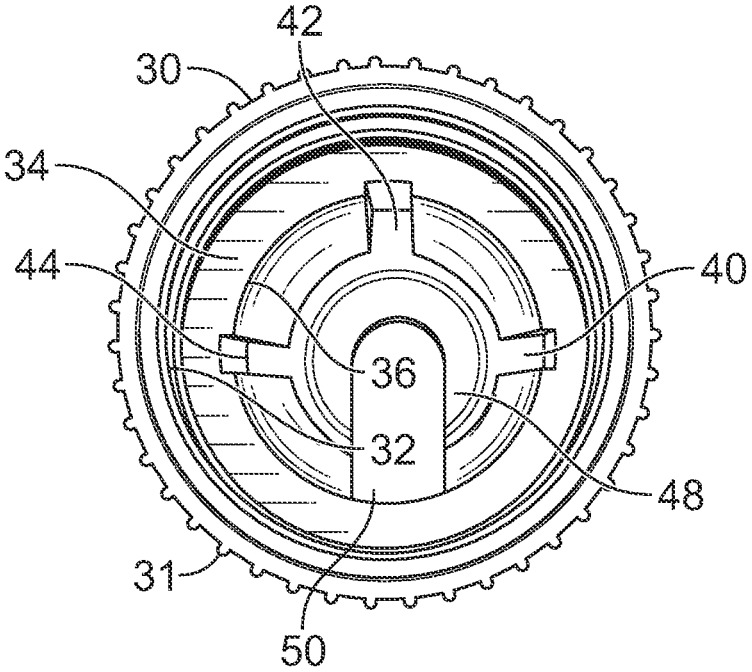
FIG. 10 is a bottom plan view of the lid component shown in FIGS. 6-9.
Figure 11:
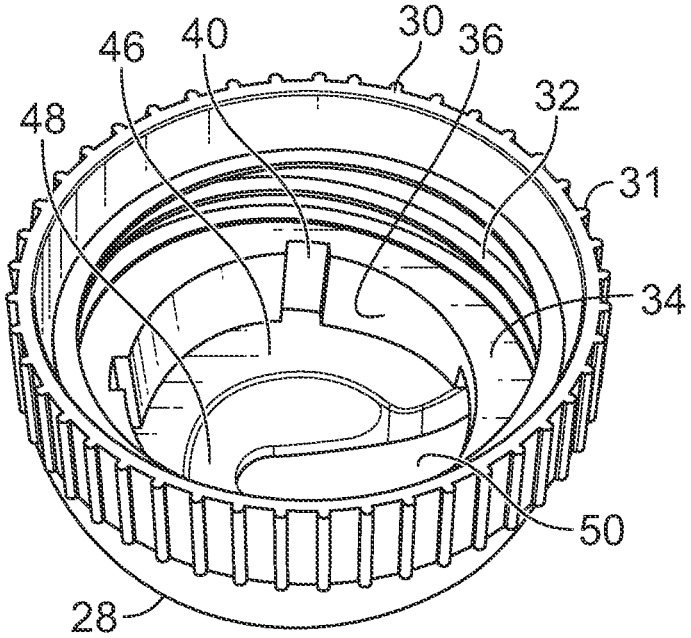
FIG. 11 is an isometric view of the bottom of the lid component shown in FIGS. 6-10.
Figure 12:
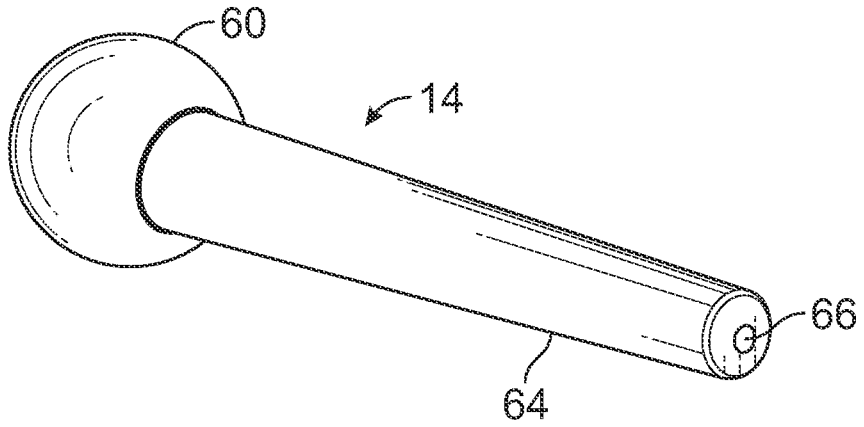
FIG. 12 is an enlarged isometric view of a nozzle component of the cap apparatus shown in FIGS. 1-3.

The lid component 20, FIGS. 6-11, includes a somewhat rounded shaped upper portion 28 and an open bottom portion 30, a threaded inner portion 32 around the open bottom 30, an outer grip portion 31, the threaded inner portion 32 for engaging a threaded outer portion (not shown) at the top of the bottle 10. Above the threaded inner portion 32 is a lower flange 34 and a sidewall 36 having multiple grooves 40, 42, 44, the grooves extending away from the lower flange 34. Above the grooves 40, 42, 44 are an upper flange 46 and a curved nozzle seat 48. A curved nozzle slot 50 extends long enough from the top of the upper portion 28 to about half way down the upper portion to allow the nozzle component 14 to move through about ninety degrees thereby allowing the nozzle to rotate between the open position as shown in FIGS. 2 and 5, and the closed position as shown in FIGS. 1 and 4.

The structure of the lid component 20 is simply constructed, easy to take apart from the bottle and other components, easy to clean and easy to reassemble. The inner diameter of the lid may be about 31 mm. The outer diameter of the bottle 10 may also be about 31 mm. In the alternative, bottles and caps of other corresponding dimensions may be used.

The nozzle component 14, FIGS. 12-15, includes a generally spherical base portion 60 with a central opening 62 and an extended cone portion 64, also with a central opening 66. The central opening 62 of the spherical base portion 60 aligns with the central opening 66 of the cone portion 64 to form one continuous opening. It is the cone portion that is able to rotate in the nozzle slot 50 of the lid component. As will be explained below, the central openings 62, 66 of the spherical base 60 and the cone portion 64, respectively, enable flowable contents in the bottle 10 to exit when the nozzle component is in the open position. The spherical base 60 is partially located in the curved nozzle seat 48 of the lid component 20. Unlike prior squeeze bottle caps, the spherical base portion 60 of the nozzle component is simply constructed and does not require opposing shafts to enable rotation. Hence, when the cap is disassembled for cleaning, for example, it may be reassembled with ease. Also, the nozzle structure is simply constructed and is easy to manufacture.

The gasket component 24, FIGS. 16-21, includes a lower circular flange portion 70 at a first level 72 with an outer diameter to fit snugly with the inner threaded portion 32 of the lid component 20 to seal the cap 12 and the bottle 10 and prevent leaks. A circular platform 74 is integral with the lower flange 70, the platform having a sidewall 76 with multiple ribs 78, 80, 82, each rib for being received by a corresponding groove 40, 42, 44 in the lid component 20. The platform includes a top wall 90 at a second level surrounding a partial spherical seat 94 to accommodate the spherical base portion 60 of the nozzle component 14. The top wall 90 is circular and extends around the gasket component to a curved recess 96 at a third level for seating the cone portion 64 of the nozzle component 14. Beneath the flange portion 70 is a lower circular or skirt wall 100.

The nozzle seat 94 in the gasket component 24 includes a central opening 102 in a bottom wall 104 that is raised or at a higher level than the bottom of the skirt wall 100, the central opening 102 being selectively aligned with the central openings 62, 66 of the nozzle base portion 60 and of the nozzle cone portion 64, respectively. When the bottle 10 is open, the central opening 102 in the of the nozzle seat 94, the central opening 62 in the spherical base 60, and the central opening 66 in the cone portion 64 are aligned with the longitudinal axis 106, FIG. 13, of the nozzle component (see FIG. 5), and these are parallel to the longitudinal axis 16 of the bottle 10, FIG. 2. In the open position, the flowable contents in the bottle may easily exit.

Figure 13:
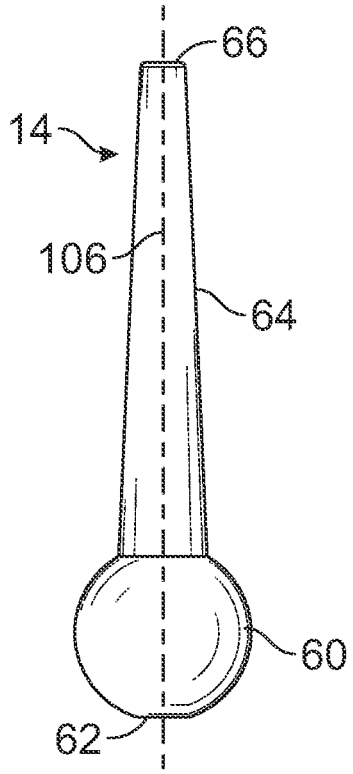
FIG. 13 is an elevation view of the nozzle component shown in FIG. 12.
Figure 14:
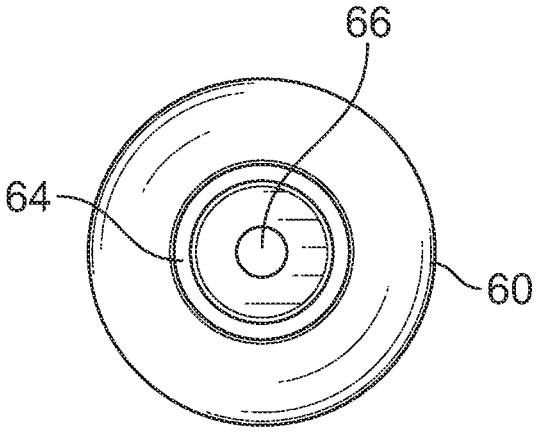
FIG. 14 is an enlarged top plan view of the nozzle component shown in FIGS. 12 and 13.
Figure 15:
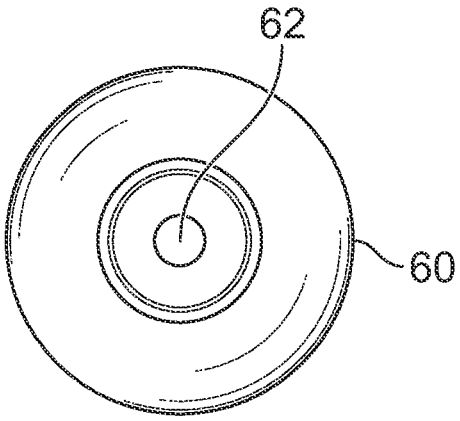
FIG. 15 is a bottom plan view of the nozzle component shown in FIGS. 12-14.
Figure 16:
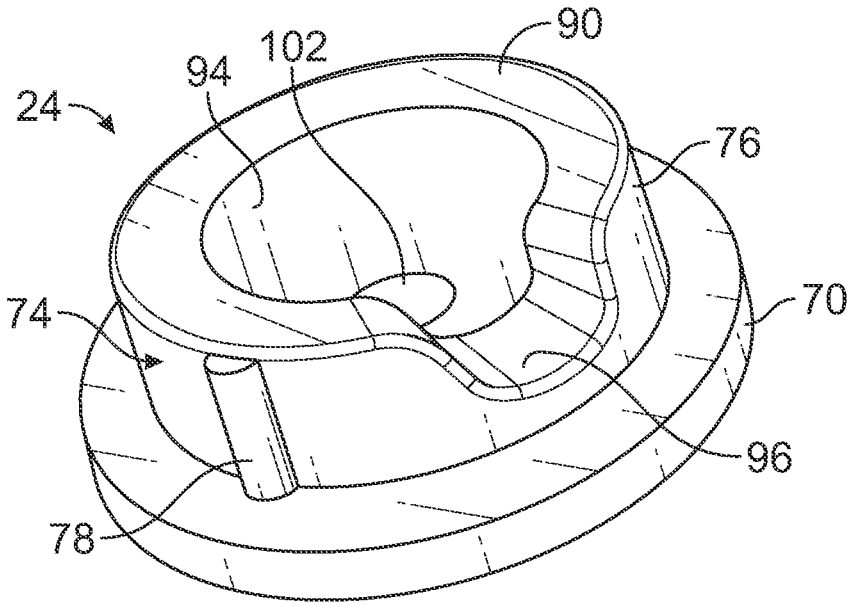
FIG. 16 is an enlarged isometric view of a gasket component of the cap apparatus shown in FIGS. 1-3.
Figure 17:
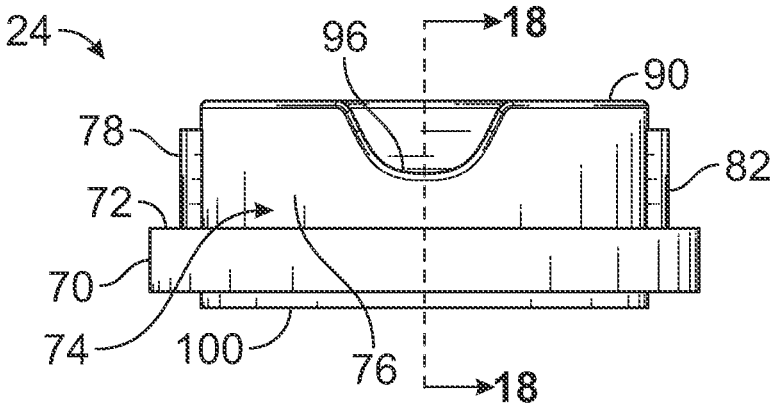
FIG. 17 is a front elevation view of the gasket component shown in FIG. 16.
Figure 18:
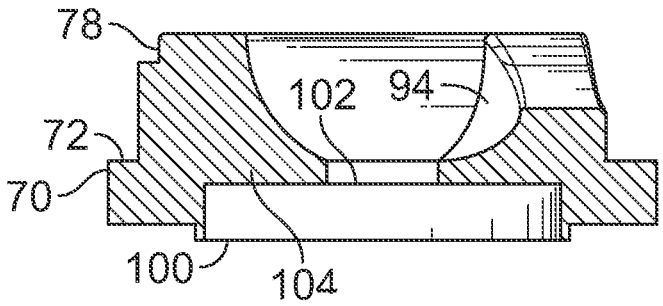
FIG. 18 is a cross-sectional view taken along line 18-18 in FIG. 17.
Figure 19:
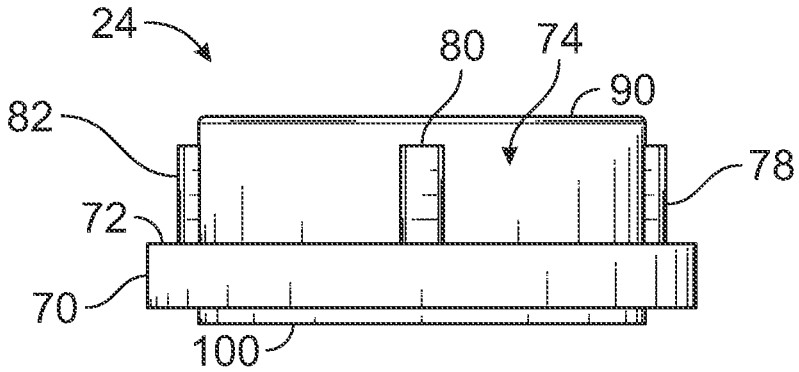
FIG. 19 is a rear elevation view of the gasket component shown in FIGS. 16-18.
Figure 20:
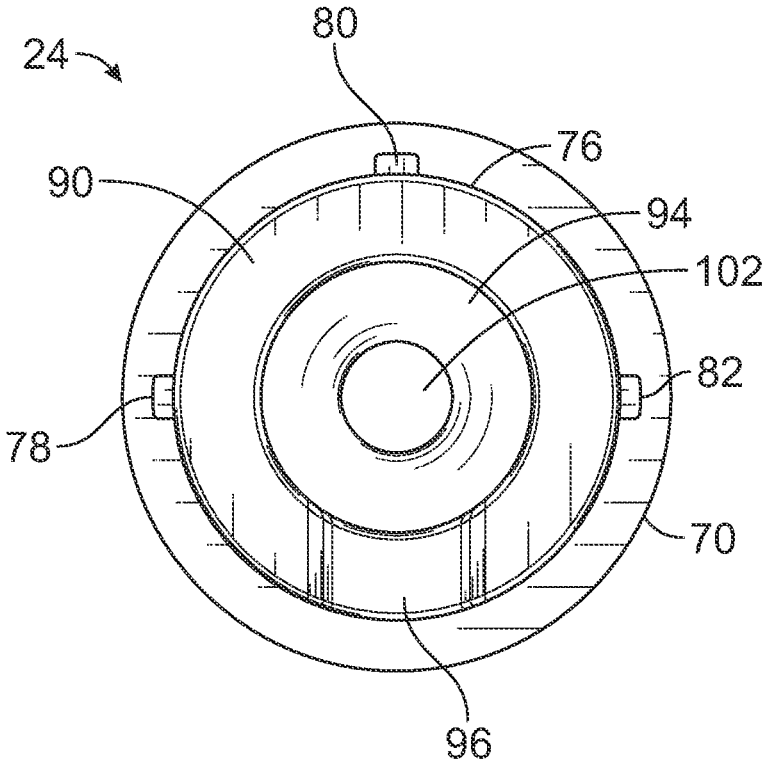
FIG. 20 is a top plan view of the gasket component shown in FIGS. 16-19.
Figure 21:
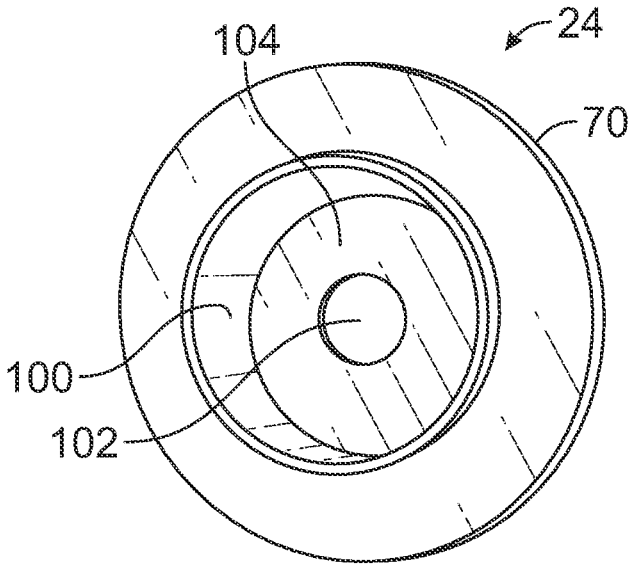
FIG. 21 is an isometric bottom view of the gasket component shown in FIGS. 16-20.
Figure 22:
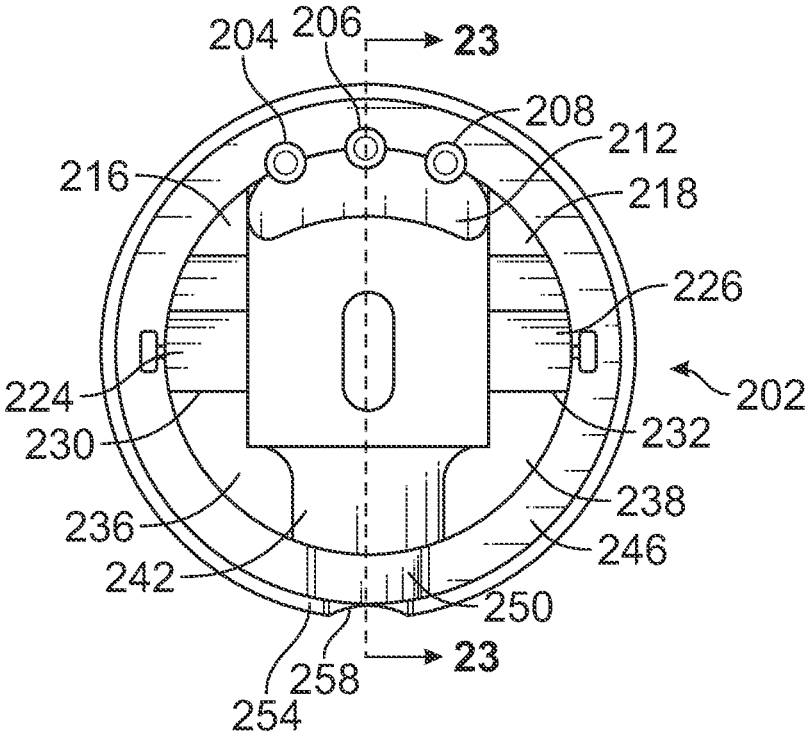
FIG. 22 (Prior Art)
FIG. 22 is a top plan view of a complicated prior art gasket.
Figure 23:
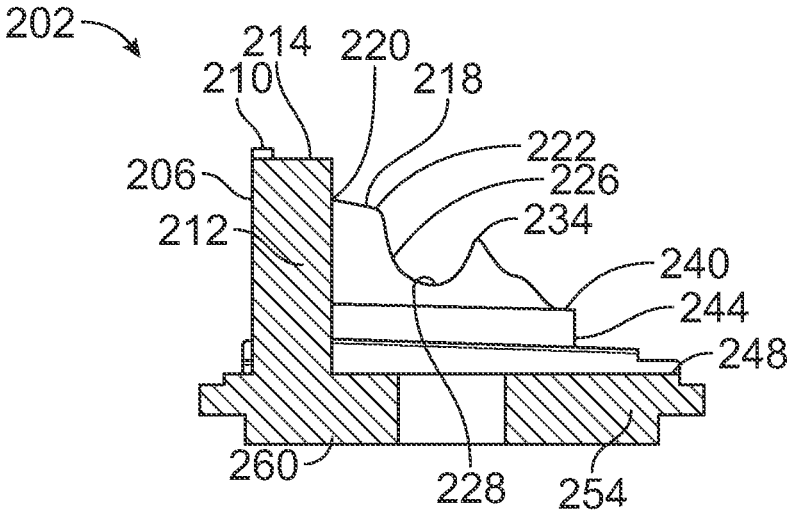
FIG. 23 (Prior Art)
FIG. 23 is a cross-sectional view taken along line 23-23 in FIG. 22.

By simply rotating the cone portion 64 of the nozzle through about ninety degrees, the central opening 62 of the spherical base 60 of the nozzle 12 is misaligned with the central opening 102 in the gasket component 24 so as to close off the contends in the bottle 10 as shown in FIGS. 1 and 4, where the longitudinal axis 106, FIG. 13, of the cone portion 64 is misaligned with the longitudinal axis 16 of the bottle, the longitudinal axis 106 of the of the cone portion of the nozzle component being generally perpendicular to the longitudinal axis 16 of the bottle. Rotation of the cone portion 64 of the nozzle may be accomplished with any portion of a user's hand, or the user may press the cone portion 64 of the nozzle component against another object to cause the nozzle component to rotate between the positions shown in FIGS. 1 and 2.

The dimension of the inner diameter of the threaded inner portion 32 of the lid component 20 is about 31 mm for a bottle having an outer threaded top of about 33 mm. The height of the bottle may be about 198 mm and may be tapered from a bottom 110 of about 64 mm to an outer diameter of about 40 mm just below the threaded portion 112. The lid and nozzle components may be formed of polypropylene and be somewhat rigid, while the gasket component may be formed of silicone and be flexible.

The flange portion 70 of the gasket component 24 may have a diameter of about 30.6 mm, and a thickness of about 2.5 mm. The height of the gasket component may be about 10.9 mm and the height of the platform may be about 6.6 mm. The diameter of the platform may be about 23.8 mm and the diameter of the skirt wall may be about 19.6 mm. The central opening 102 may have a diameter of about 6 mm and the recess 96 may have a radius of about 4.1 mm and a width of about 8.11 mm. The nozzle seat 94 may have a diameter of about 13.91 mm.

Like the lid and nozzle components, the gasket component is simply constructed resulting in the cap being easily reassembled after being disassembled for cleaning, for example. The three components are cheaper to manufacture and assemble, less likely to leak, will last longer and have better temperature, pressure and corrosion resistance than the prior art caps.

Several more advantages are achieved than those already mentioned above. With the simplified structure, washing and filing the bottle is simple. When the cap is twisted off the bottle, the three components do not fall apart. And because of their simple construction, the components are easily reassembled. The cone portion of the nozzle component 14 is merely inserted into the slot 50 of the lid component 20 and the gasket component 24 is aligned with the spherical base 60 and the cone portion 64 of the nozzle component. Thereafter, the gasket component is pressed into place in the lid component.

In comparison, a prior-art cap shown in FIGS. 22-25, all of the parts have overly complicated structure that makes them more difficult and expensive to make and assemble, and seem to result in a poorer performance. For example, the prior art gasket 202, FIGS. 22 and 23, has three pillars 204, 206 208 that extends to a first level 210, a partial wall 212 that extends to a second level 214, two shoulders 216, 218 starting at a third level 220 and descending to a fourth level 222, two oppositely disposed curved surfaces 224, 226 dipping to a fifth level 228, both curved surfaces ending at peaks 230, 232 at a sixth level 234, a second set of descending surfaces 236, 238 ending at a seventh level 240, a nozzle seat 242 at an eighth level 244, a top ring base 246 at a ninth level 248 with a recess 250 at a tenth level 252, a lower base 254 at an eleventh level 256 having an indentation 258, and a bottom base 260.

Figure 24:
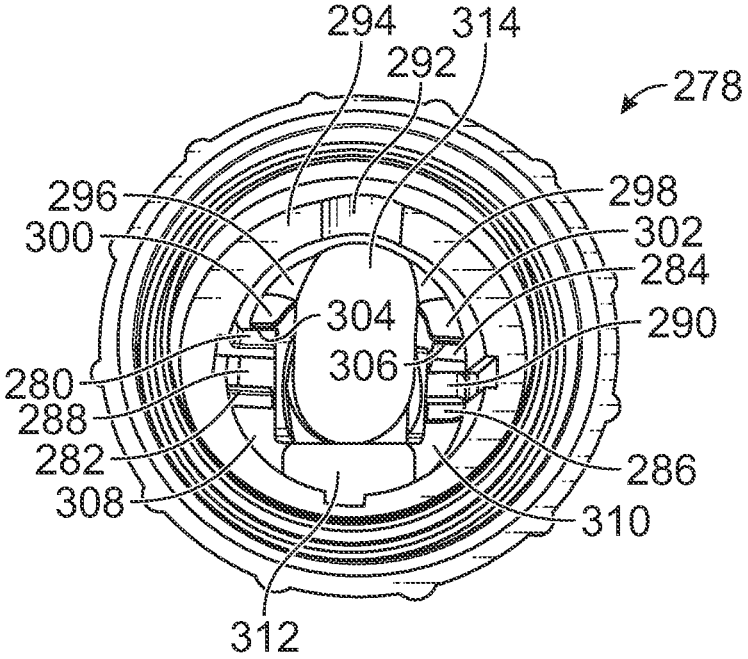
FIG. 24 (Prior Art)
FIG. 24 is a bottom plan view of a complicated prior art lid.
Figure 25:
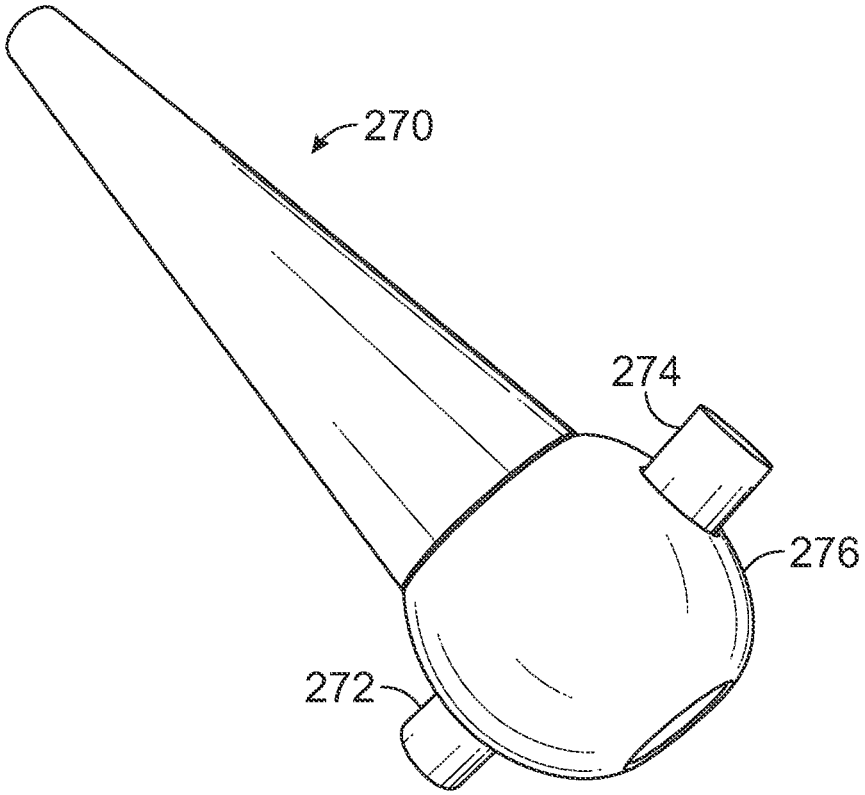
FIG. 25 (Prior Art)
FIG. 25 is an isometric view of a complicated prior art nozzle.

A prior art nozzle 270, FIG. 25, includes two lateral shafts 272, 274 extending from a base 276 that also requires the extra steps of aligning with a prior art lid 278, FIG. 24, and the prior art gasket 202 when the prior art cap is reassembled. The prior art cap is formed of rubber, which is inferior to silicon and has been found to leaks in use.

The prior art lid 278, FIG. 24, also has numerous levels in order to accommodate the complicated prior art gasket 202. The prior art lid and gasket compliment each other whereby the lid 278 has many levels like the gasket, which results in the lid having a very complex structure. For example, the prior art lid 278 includes two pairs of horizontal ribs 280, 282, 284, 286 for seating the lateral shafts 272, 274 of the nozzle in a pair of horizontal 'valleys' 288, 290, a recess 292 in a flange 294, a first pair of generally horizontal surfaces 296, 298 contiguous, respectively, with slanted surfaces 300, 302, a pair of vertical walls 304, 306, a pair of curved walls 308, 310 and a curved back wall 312 near the top of a lid slot 314.

Operation of the inventive cap 12 relative to the bottle 10 is very simple. The cap 12 is easily removed from the bottle 10 by twisting the cap in a counterclockwise direction when the user is ready to fill the bottle with a flowable content such as ketchup, hair dye, soap and the like. After washing, the nozzle and gasket components are inserted into the lid component, and the lid component is twisted clockwise.

It is noted that throughout this detailed description, words such as "forward," "rearward," "upper," "lower," "front," "rear," "top" and "bottom," as well as similar positional terms, refer to portions or elements of the cap as they are viewed in the drawings, or in relationship to the positions of the apparatus as it will typically be deployed and moved during use, or to movements of elements based on the configurations illustrated.

Figure 26:
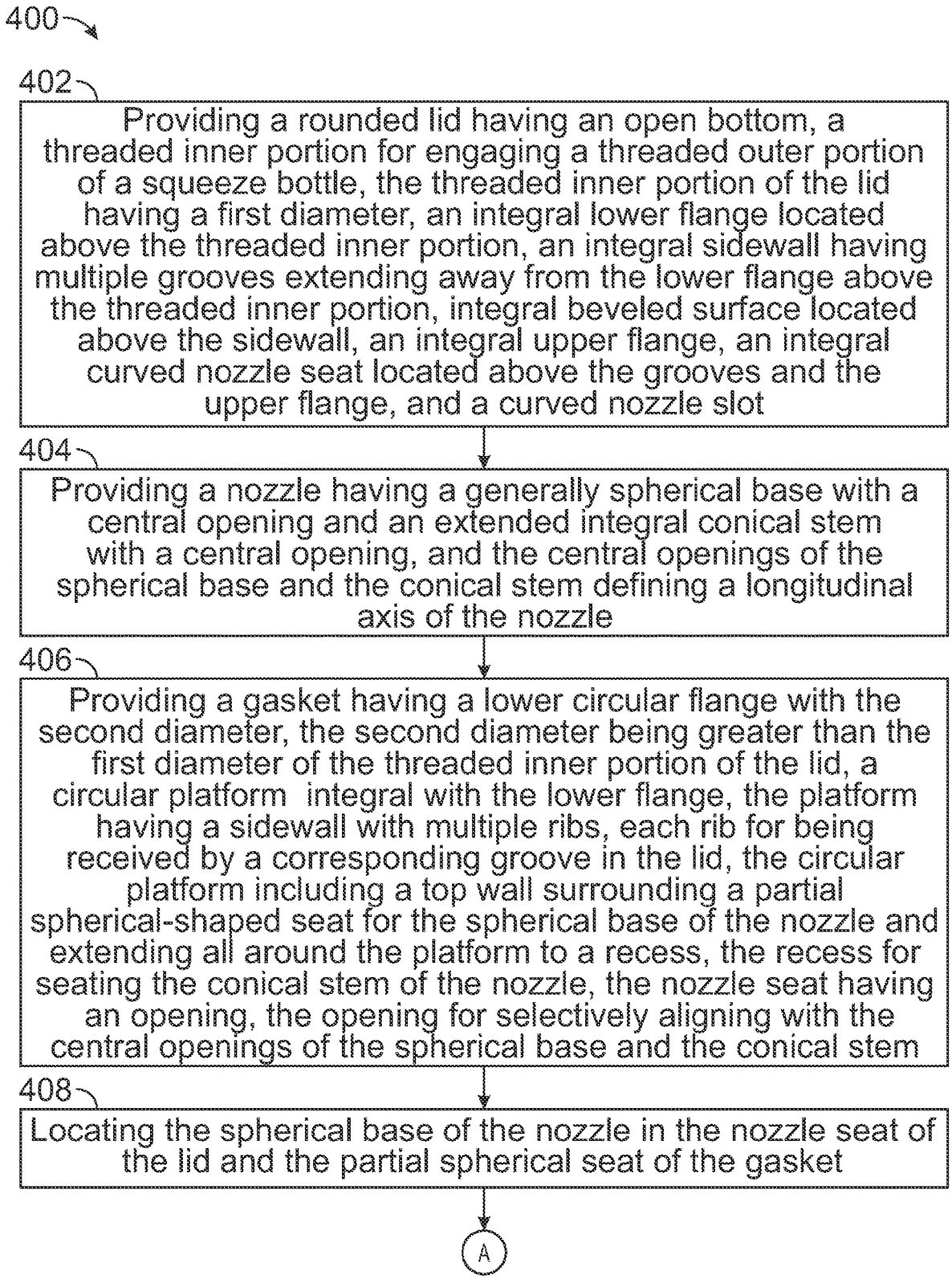
FIG. 26 is a flow chart of a method for assembling a cap for use with a squeeze bottle.
Figure 26:
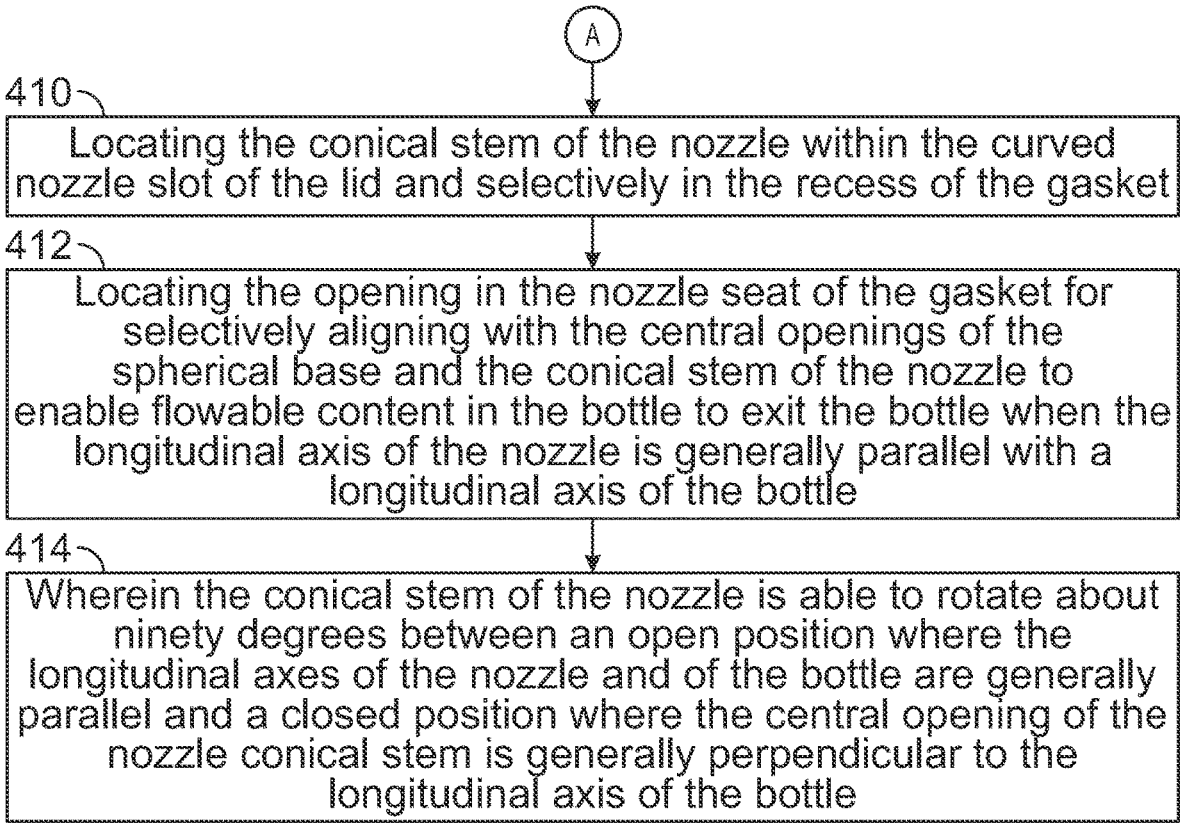

The present invention includes a method 400, FIG. 26, for assembling a cap apparatus for a squeeze bottle including the steps of providing a rounded lid having an open bottom, a threaded inner portion for engaging a threaded outer portion of a squeeze bottle, the threaded inner portion of the lid having a first diameter, an integral lower flange located above the threaded inner portion, an integral sidewall having multiple grooves extending away from the lower flange above the threaded inner portion, an integral beveled surface located above the sidewall, an integral upper flange, an integral curved nozzle seat located above the grooves and the upper flange, and a curved nozzle slot 402; providing a nozzle having a generally spherical base with a central opening and an extended integrally conical stem with a central opening, and the central openings of the spherical base and the conical stem defining a longitudinal axis of the nozzle 404; providing a gasket having a lower circular flange with a second diameter in use, the second diameter being greater than the first diameter of the threaded inner portion of the lid, a circular platform integral with the lower flange, the platform having a sidewall with multiple ribs, each rib for being received by a corresponding groove in the lid, the circular platform including a top wall surrounding a partial spherical-shaped seat for the spherical base of the nozzle and extending all around the platform to a recess, the recess for seating the conical stem of the nozzle, the nozzle seat having an opening, the opening for selectively aligning with the central openings of the spherical base and the conical stem 406; locating the spherical base of the nozzle in the nozzle seat of the lid and the partial spherical seat of the gasket 408; locating the conical stem of the nozzle within the curved nozzle slot of the lid and selectively in the recess of the gasket 410; locating the opening in the nozzle seat of the gasket for selectively aligning with the central openings of the spherical base and the conical stem of the nozzle to enable flowable content in the bottle to exit the bottle when the longitudinal axis of the nozzle is generally parallel with a longitudinal axis of the bottle 412, wherein the conical stem of the nozzle is able to rotate about ninety degrees between an open position where the longitudinal axes of the nozzle and of the bottle are generally parallel and a closed position where the central opening of the nozzle conical stem is generally perpendicular to the longitudinal axis of the bottle 414.

From the foregoing, it can be seen that there has been provided a detailed description of features for an improved squeeze bottle cap apparatus as well as a disclosure of a method for making the cap apparatus. While particular embodiments of the present invention has been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A cap for a squeeze bottle comprising:

a lid component having a rounded shape, an open bottom, a threaded inner portion for engaging a threaded outer portion of a bottle, the threaded inner portion of the lid having a first diameter, the lid component also having an integral lower flange located above the threaded inner portion, an integral sidewall having multiple grooves extending away from the lower flange above the threaded inner portion, an integral beveled surface above the sidewall, an integral upper flange, an integral curved nozzle seat located above the grooves and the upper flange, and a curved nozzle slot;

a nozzle component having a spherical base with a central opening and an extended conical stem with a central opening, a centerline of the central openings of the base and the conical stem defining a longitudinal axis of the nozzle component, the spherical base for being received by the nozzle seat of the lid component, and the conical stem for rotating within the curved nozzle slot; and a gasket component having a lower circular flange, a circular platform integral with the lower flange, the platform having a sidewall with multiple ribs, each rib for being received by a corresponding groove in the lid component, the circular platform including a top wall surrounding a partial spherically shape seat for the base of the nozzle component, and the top wall extending around to a recess for seating the conical stem of the nozzle, the nozzle seat having a central opening, the central opening in the nozzle seat for selectively aligning with the central openings of the base of the nozzle and the conical stem of the nozzle component to enable flowable content of the bottle to exit the bottle wherein the conical stem of the nozzle component is able to rotate about ninety degrees between a closed position where the bottle is closed and the conical stem of the nozzle component is perpendicular to a longitudinal axis of the bottle and an open position where the bottle is open and the conical stem of the nozzle component is parallel to the longitudinal axis of the bottle.

2. The squeeze bottle cap claimed in claim 1, wherein:

the top wall of the gasket component is at a constant height except at a recess dimensioned to support the conical stem of the nozzle component.

3. The squeeze bottle cap claimed in claim 1, wherein:

the upper flange of the lid component extends around the lid component except at the curved nozzle slot.

4. The squeeze bottle cap claimed in claim 1, wherein:

the beveled surface of the lid component extends around the lid component except for spaces occupied by the curved nozzle slot and the grooves.

5. The squeeze bottle cap claimed in claim 1, wherein:

the seat for the base of the nozzle component in the gasket component is shaped as a partial sphere.

6. The squeeze bottle cap claimed in claim 1, wherein:

the gasket component includes a lower circular wall.

7. The squeeze bottle cap claimed in claim 6, wherein:

the nozzle seat of the gasket component is at a higher level than the lower circular wall.

8. The squeeze bottle cap claimed in claim 1, wherein:

the top wall of the gasket component is at a constant height except at a recess dimensioned to support the conical stem of the nozzle component; and the upper flange of the lid component extends around the lid component except at the curved nozzle slot.

9. The squeeze bottle cap claimed in claim 1, wherein:

the beveled surface of the lid component extends around the lid component except for spaces occupied by the curved nozzle slot and the grooves, and the seat for the base of the nozzle component in the gasket component is shaped as a partial sphere.

10. The squeeze bottle cap claimed in claim 1, wherein:

the gasket component includes a lower circular wall; and the nozzle seat of the gasket component is at a higher level than the lower circular wall.

11. The squeeze bottle cap claimed in claim 1, wherein:

the top wall of the gasket component is at a constant height level except at a recess dimensioned to support the conical stem of the nozzle component;

the lower flange of the lid component extends around the lid component except at the curved nozzle slot; and the beveled surface of the lid component extends around the lid component except for spaces occupied by the curved nozzle slot and the grooves.

12. The squeeze bottle cap claimed in claim 1, wherein:

the top wall of the gasket component is at a constant height except at a recess dimensioned to support the conical stem of the nozzle component;

the lower flange of the lid component extends around the lid component except at the curved nozzle slot; and the seat for the base of the nozzle component in the gasket component is shaped as a partial sphere.

13. The squeeze bottle cap claimed in claim 1, wherein:
the top wall of the gasket component is at a constant height except at a recess dimensioned to support the conical stem of the nozzle component;
the lower flange of the lid component extends around the lid component except at the curved nozzle slot; and
the gasket component includes a lower circular wall.

14. The squeeze bottle cap claimed in claim 1, wherein:
the top wall of the gasket component is at a constant height except at a recess dimensioned to support the conical stem of the nozzle component;
the lower flange of the lid component extends around the lid component except at the curved nozzle slot;
the gasket component includes a lower circular wall; and
the nozzle seat of the gasket component is at a higher level than the lower circular wall.

15. The squeeze bottle cap claimed in claim 1, wherein:
the top wall of the gasket component is at a constant height except at a recess dimensioned to support the conical stem of the nozzle component;
the lower flange of the lid component extends around the lid component except at the curved nozzle slot;
the beveled surface of the lid component extends around the lid component except for spaces occupied by the curved nozzle slot and the grooves;
the seat for the base of the nozzle component in the gasket component is shaped as a partial sphere; and
the gasket component includes a lower circular wall.

16. The squeeze bottle cap claimed in claim 1, wherein:
the top wall of the gasket component is at a constant height except at a recess dimensioned to support the conical stem of the nozzle component;
the lower flange of the lid component extends around the lid component except at the curved nozzle slot;
the beveled surface of the lid component extends around the lid component except for spaces occupied by the curved nozzle slot and the grooves;
the seat for the base of the nozzle component in the gasket component is shaped as a partial sphere;
the gasket component includes a lower circular wall; and
the nozzle seat of the gasket component is at a higher level than the lower circular.

17. A cap for a squeeze bottle comprising:
a lid component having a rounded shape, an open bottom, a threaded inner portion for engaging a threaded outer portion of a bottle, the threaded inner portion of the lid having a first diameter, the lid component also having an integral lower flange located above the threaded inner portion, an integral sidewall having multiple grooves extending away from the lower flange above the threaded inner portion, an integral beveled surface above the sidewall, an integral upper flange, an integral curved nozzle seat located above the grooves and the upper flange, and a curved nozzle slot;
a nozzle component having a spherical base with a central opening and an extended conical stem with a central opening, a centerline of the central openings of the base and the conical stem defining a longitudinal axis of the nozzle component, the spherical base for being received by the nozzle seat of the lid component, and the conical stem for rotating within the curved nozzle slot; and
a gasket component having a lower circular flange with a second diameter greater than the first diameter of the threaded inner portion of the lid, a circular platform integral with the lower flange, the platform having a sidewall with multiple ribs, each rib for being received by a corresponding groove in the lid component, the circular platform including a top wall surrounding a partial spherically shape seat for the base of the nozzle component, and the top wall extending around to a recess for seating the conical stem of the nozzle component, the nozzle seat having a central opening, the central opening in the nozzle seat for selectively aligning with the central openings of the base and the conical stem of the nozzle component to enable flowable content of the bottle to exit the bottle wherein the conical stem of the nozzle component is able to rotate about ninety degrees between a closed position where the bottle is closed and the conical stem of the nozzle component is perpendicular to a longitudinal axis of the bottle and an open position where the bottle is open and the conical stem of the nozzle component is parallel to the longitudinal axis of the bottle.

18. A method for assembling a cap apparatus for a squeeze bottle comprising the steps of:
providing a rounded lid component having an open bottom, a threaded inner portion for engaging a threaded outer portion of a squeeze bottle, the threaded inner portion of the lid having a first diameter, an integral lower flange located above the threaded inner portion, an integral a sidewall having multiple grooves extending away from the lower flange above the threaded inner portion, an integral beveled surface located above the sidewall, an integral upper flange, an integral curved nozzle seat located above the grooves and the upper flange, and a curved nozzle slot;
providing a nozzle component having a spherical base with a central opening and an extended conical stem with a central opening, a centerline of the central openings of the spherical base and the conical stem defining a longitudinal axis of the nozzle component;
providing a gasket component having a lower circular flange, a circular platform integral with the lower flange, the platform having a sidewall with multiple ribs, each rib for being received by a corresponding groove in the lid, the circular platform including a top wall surrounding a partial spherical-shaped seat for the spherical base of the nozzle component and extending around the platform to a recess, the recess for seating the conical stem of the nozzle component, the nozzle seat having an opening for selectively aligning with the central openings of the spherical base and the conical stem;
locating the spherical base of the nozzle component in the nozzle seat of the lid component and the partial spherical scat of the gasket component;
locating the conical stem within the curved nozzle slot of the lid component and selectively in the recess of the gasket component;
locating the opening in the nozzle seat of the gasket component for selectively aligning with the central openings of the spherical base and the conical stem of the nozzle component to enable flowable content in the bottle to exit the bottle when the longitudinal axis of the nozzle component is parallel with a longitudinal axis of the bottle wherein the conical stem of the nozzle component is able to rotate about ninety degrees between an open position where the longitudinal axes of the nozzle component and of the bottle are parallel and a closed position where the central opening of the conical stem of the nozzle is perpendicular to the longitudinal axis of the bottle.

19. The method claimed in claim 18, wherein:

the top wall of the platform of the gasket component is at a constant height except at a recess dimensioned to support the conical stem of the nozzle component.

20. The method claimed in claim 19, wherein:

the lower flange of the lid component extends around the lid component except at the curved nozzle slot.

* * * * *